US009980582B1

(12) United States Patent
Levy et al.

(10) Patent No.: US 9,980,582 B1
(45) Date of Patent: May 29, 2018

(54) COMBINED BIN AND PEGBOARD ATTACHMENT

(71) Applicant: Navajo Manufacturing Company, Inc., Denver, CO (US)

(72) Inventors: Gordon Levy, Golden, CO (US); Shawn Shelton, Denver, CO (US)

(73) Assignee: NAVAJO MANUFACTURING COMPANY, INC., Denver, CO (US)

( * ) Notice: Subject to any disclaimer, the term of this patent is extended or adjusted under 35 U.S.C. 154(b) by 0 days. days.

(21) Appl. No.: 15/641,676

(22) Filed: Jul. 5, 2017

(51) Int. Cl.
*A47F 5/08* (2006.01)
*A47F 5/00* (2006.01)

(52) U.S. Cl.
CPC ..... *A47F 5/0823* (2013.01); *A47F 5/0018* (2013.01)

(58) Field of Classification Search
CPC ..... B25H 3/04; B65D 5/4208; A47B 96/067; A47F 5/0823; A47F 5/0846; A47F 5/0025; A47F 5/005; A47F 5/0018
See application file for complete search history.

(56) References Cited

U.S. PATENT DOCUMENTS 4,154,356 A * 5/1979 Schieve ..... A47F 5/0823 211/88.01
4,155,459 A * 5/1979 Marschak ..... A47F 5/0823 211/49.1
4,322,006 A * 3/1982 Marschak ..... A47F 5/0823 211/126.2
4,452,360 A * 6/1984 Barnes ..... A47F 5/0823 211/59.1
D285,168 S * 8/1986 Van Arsdell ..... 248/311.2
4,632,256 A * 12/1986 Gambello ..... A47F 5/0823 211/175
4,801,116 A * 1/1989 Blankenship ..... A47F 5/0823 211/59.1
5,706,977 A * 1/1998 Ogura ..... A47F 1/08 221/197
6,601,808 B1 * 8/2003 Nagel ..... A47F 5/0823 211/57.1
7,338,021 B2 * 3/2008 Barkdoll ..... A47F 5/0823 211/57.1
7,428,972 B2 * 9/2008 Warner ..... A47F 5/0823 211/59.1
8,042,700 B1 * 10/2011 Smalley ..... A47F 5/0807 211/88.01
2005/0189308 A1 * 9/2005 Warner ..... A47F 5/0823 211/59.1

* cited by examiner

*Primary Examiner* — Patrick D Hawn
(74) *Attorney, Agent, or Firm* — Studebaker & Brackett PC

(57) ABSTRACT

A bin is slidably mounted on an attachment piece for mounting of the bin on a pegboard. The bin includes rod portions inter-engaging with two U-shaped arms located on the attachment piece. The bin is slidable at least three quarters of an inch from side to side with the rod frictionally engaging the U-shaped arms of the attachment piece.

6 Claims, 4 Drawing Sheets

COMBINED BIN AND PEGBOARD ATTACHMENT

FIELD OF THE INVENTION

The present invention relates to the inter-engagement of a storage bin and a pegboard mounting mechanism for mounting the bin on a pegboard.

BACKGROUND OF THE INVENTION

In the mounting of various items for sale on a pegboard, multiple bins are usually used. The bins are removably mounted on the pegboard.

However, to remove a single bin, the front end of the bin must be elevated to such a height such that any bins located above the bin to be removed must also be removed to provide the necessary clearance. This is a time-consuming and therefore an expensive proposition.

It is also necessary to have the width of the pegboard equal to the width of a multiple of bins in a row so that a predetermined number of bins may be located across the width of the pegboard to maximize use of shelf space. If the width of the pegboard does not equal the width of a predetermined number of bins in a row, part of the width of the pegboard goes unused. This is a waste of valuable shelf space.

SUMMARY OF THE INVENTION

It is therefore an object of the present invention to provide a bin which is mounted on a pegboard by a separate attachment piece. The bins are slidable from side to side on the attachment piece to accommodate positioning of a number of bins in a row across a width of the pegboard where the pegboard width is less than the combined width of all of the bins in the row. By allowing a bin to slide horizontally on an attachment piece, a width of a pegboard may be less than a combined width of a row of bins mounted on the pegboard.

When each bin is fixed in place, if a width of a pegboard is less than the width of a row of bins, empty space on the pegboard would be left at the ends of each row of bins. This would result in the waste of pegboard space.

Further, by having each of the bins mounted on a separate attachment piece on a pegboard, each individual bin may be easily removed by separating the bin from the attachment piece, leaving the attachment piece on the pegboard. This is performed by a slight elevating of the bin to disengage from coupling arms of the attachment piece. A cylinder shaped rod projecting from a rear of the bin is removably mounted within the coupling arms. No disruption to a row of elevated bins above the bins would be made to remove a single lower bin.

Accordingly, it is an object of the present invention to provide a bin slidably mounted on an attachment piece for mounting of the bin on a pegboard.

It is another object of the present invention to provide a bin slidably mounted on an attachment piece for mounting of the bin on a pegboard with the bin including a rod inter-engaging by a snap fit with two U-shaped arms located on the attachment piece.

It is still yet another object of the present invention to provide a bin slidably mounted on an attachment piece for mounting of the bin on a pegboard with the bin including a rod inter-engaging with two U-shaped arms located on the attachment piece so that the bin is slidable at least three quarters of an inch from side to side.

It is still yet another object of the present invention to provide a bin slidably mounted on an attachment piece for mounting of the bin on a pegboard with the bin including a rod inter-engaging with two U-shaped arms located on the attachment piece so that the bin is slidable at least three quarters of an inch from side to side with the rod frictionally engaging the U-shaped arms of the attachment piece.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the invention disclosed herein, and are for illustrative purposes only. Other embodiments that are substantially similar can use other components that have a different appearance.

DETAILED DESCRIPTION OF THE PREFERRED EMBODIMENTS

Figure 1:
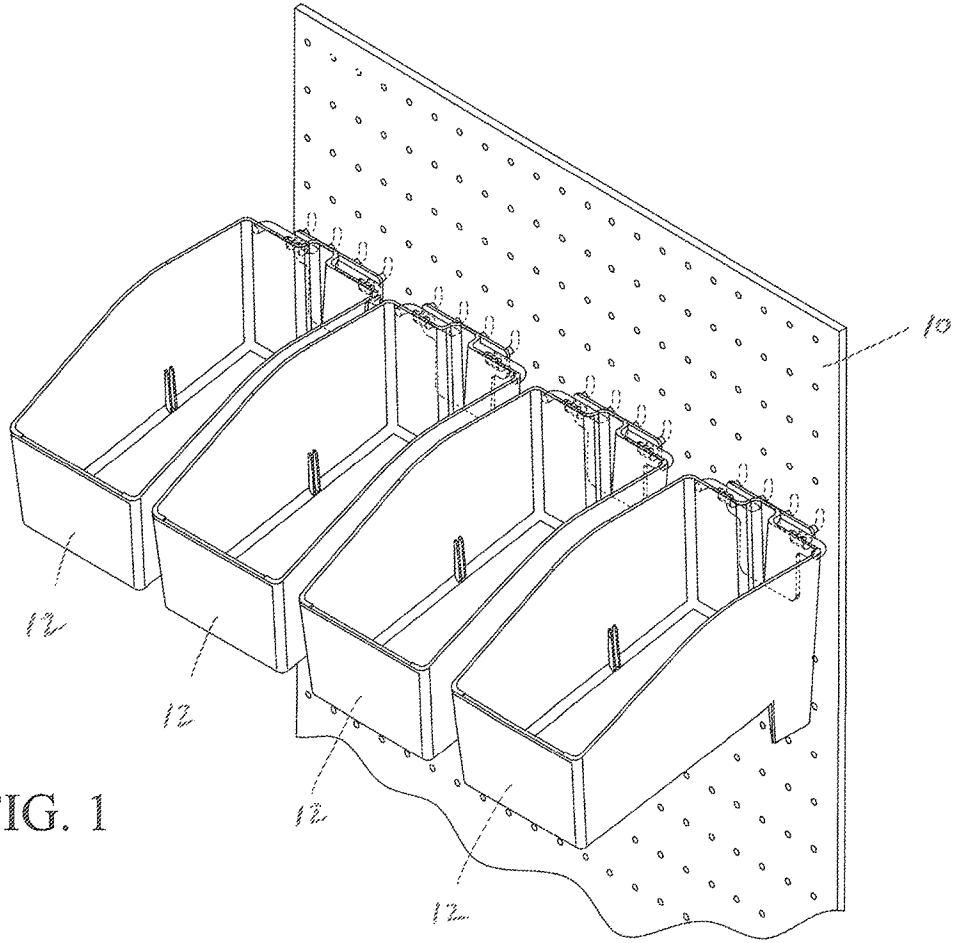
FIG. 1 is a perspective view of a row of bins mounted on a pegboard by the mounting mechanism of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
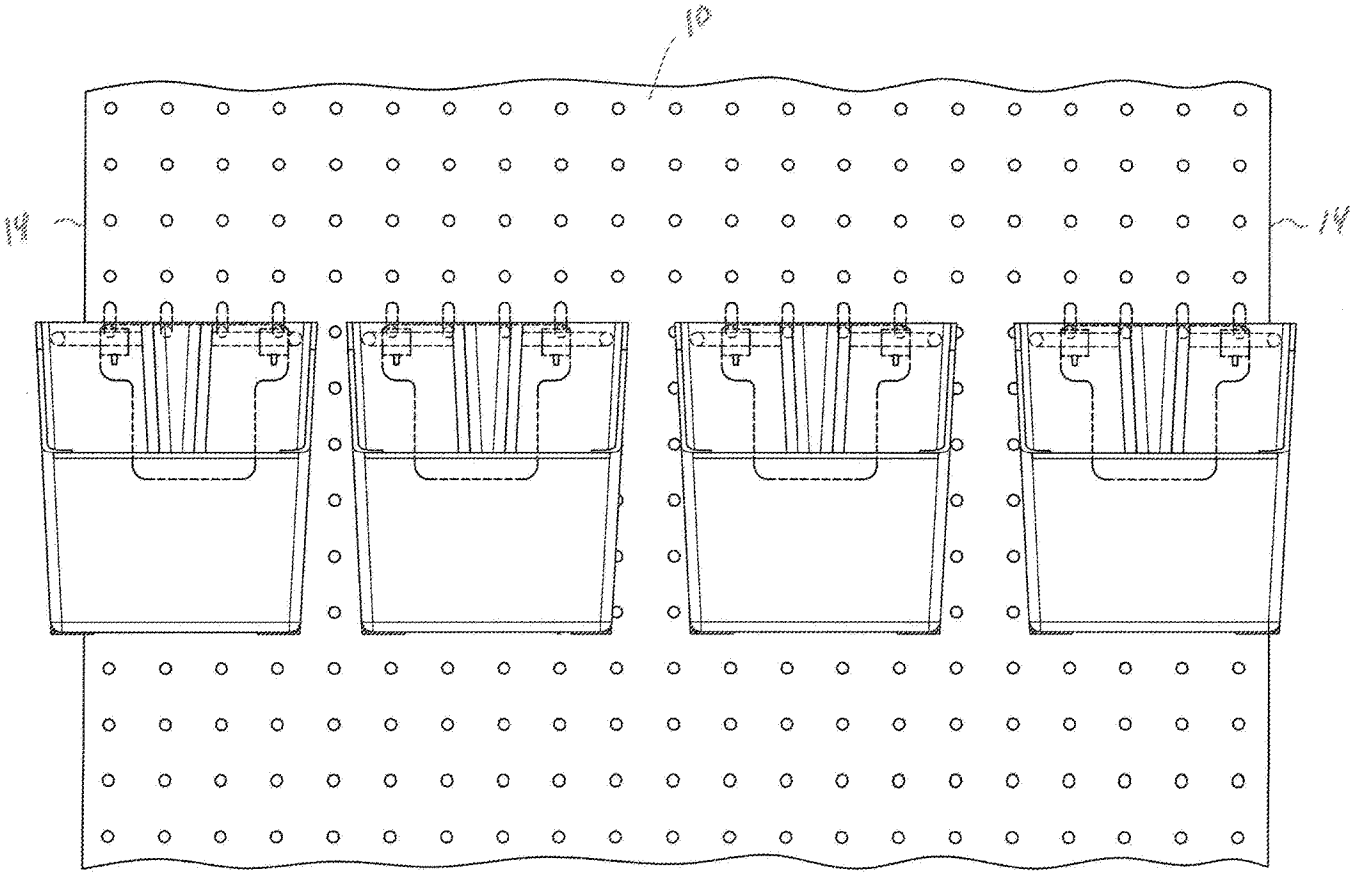
FIG. 2 is a front view of the row of bins mounted on the pegboard shown in FIG. 1.
Figure 4:
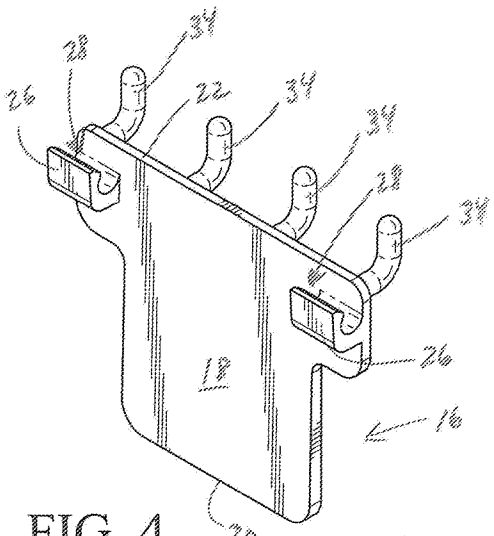
FIG. 4 is a front perspective view illustrating the attachment piece for mounting on a pegboard.
Figure 5:
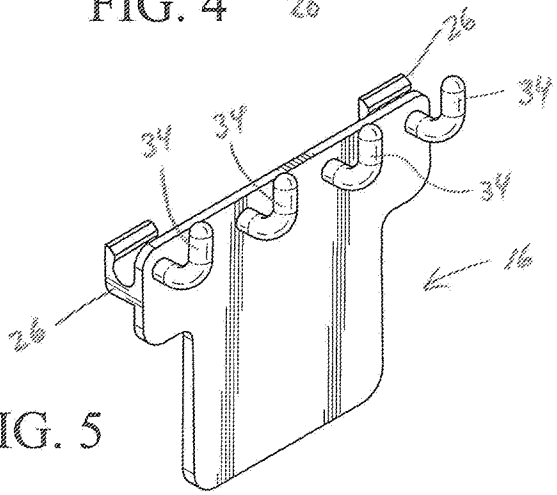
FIG. 5 is a rear perspective view of the attachment piece for mounting on a pegboard.
Figure 3:
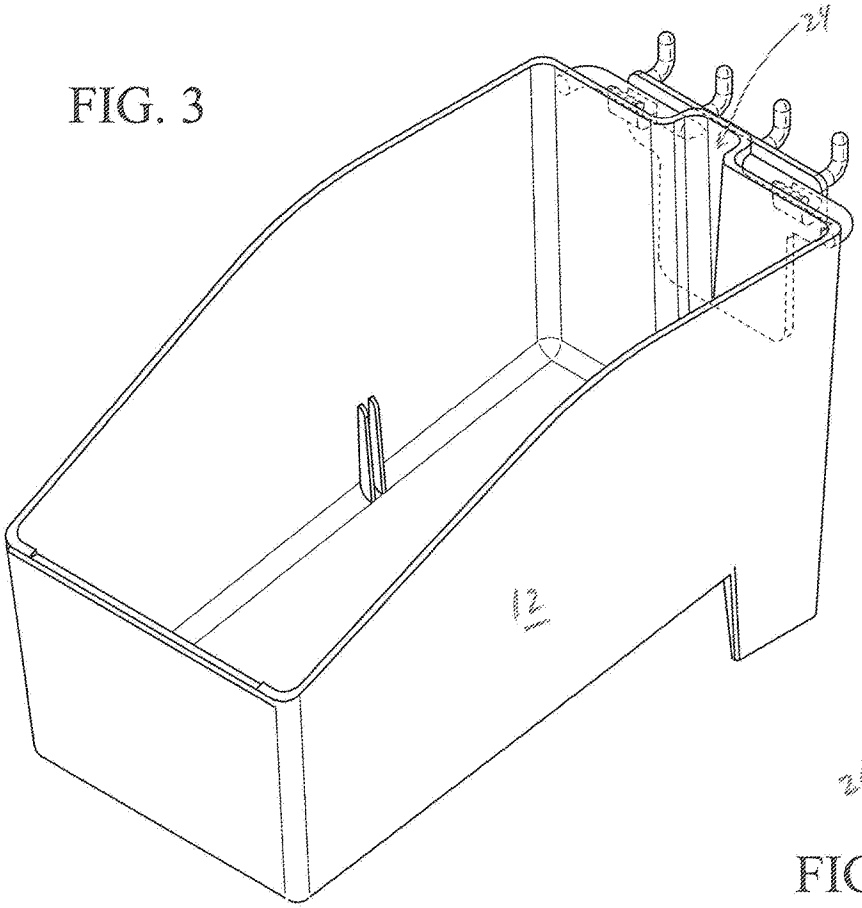
FIG. 3 is a perspective view of a bin inter-engaged with an attachment piece as used in the present invention.
Figure 8:
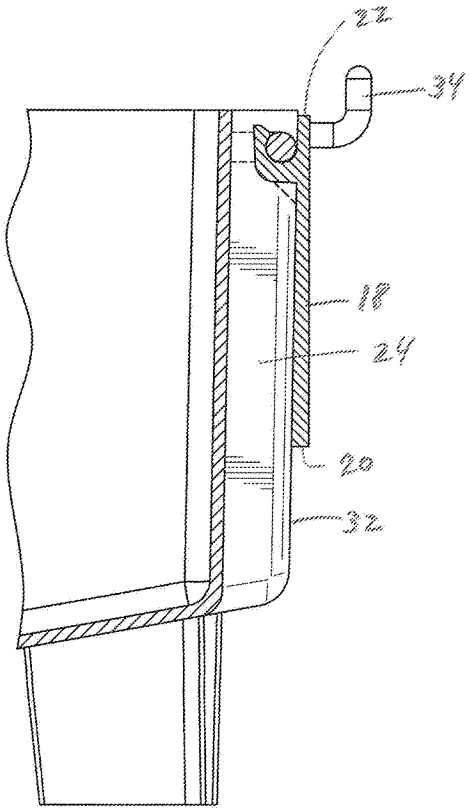
FIG. 8 is a sectional view taken along line 8-8 shown in FIG. 6.
Figure 7:
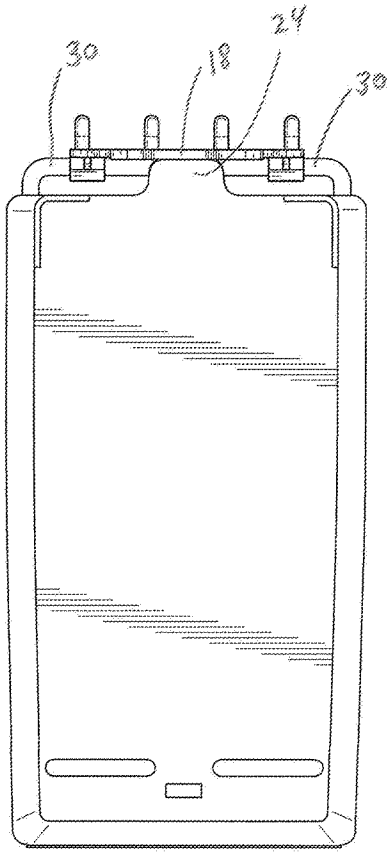
FIG. 7 is a bottom view of the inter-engagement of the bin and the attachment piece shown in FIG. 7.
Figure 6:
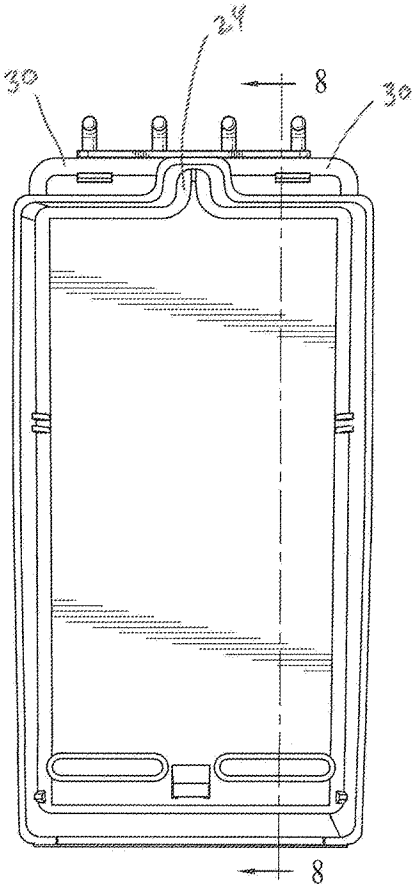
FIG. 6 is a top view illustrating the inter-engagement of a bin and an attachment piece of the present invention.

As shown in FIGS. 1 and 2, a pegboard 10 is mounted onto a wall of a display cabinet for retail sales. As is known from a construction of a pegboard, a series of rows and columns of holes are symmetrically arranged over the entire surface of the pegboard. In FIG. 1, four bins 12 are arranged in a row across the width of pegboard 10.

As further shown in FIG. 2, the width of the row of bins 12 overlap the side edges 14 of the pegboard. The bins 12 are thereby spaced across the width of the pegboard. This arrangement has been made possible by the present invention. Without the present invention, only three bins could have been accommodated across the width of the pegboard 10.

As shown in more detail with reference to FIGS. 3 through 8, an attachment piece 16 made of a durable flexible plastic is used to interconnect each bin 12 to the pegboard 10. The attachment piece 16 includes a T-shaped plate 18 of narrowing thickness from a bottom edge 20 to a top edge 22, as more clearly shown in the sectional view of FIG. 8. The tapering thickness of the plate 18 is used to provide a slight angle to the body of the bin 12 so that when the bin is attached to the attachment piece 16 and the attachment piece 16 inserted into a pegboard 10, the weight of the contents of the bin are spread out evenly on the pegboard by the attachment piece. This is because of the complete contact between a U-shaped projection 24 at the rear of the bin and the pegboard by the interposed plate 18.

Returning to the attachment piece, projecting from one side of the plate 18 are two U-shaped arms 26. The arms 26 provide a gap 28 for receipt therein by a snap friction fit of two rod portions 30 extending away from a rear surface 32 of the bin. The rod portions are turned so as to initially extend away from the bin and then to extend parallel to the rear surface 32 of the bin.

The attachment piece on the opposite side of the plate 18 from the arms 26 includes four L-shaped hooks 34. Hooks 34 are used for inter-engagement in the holes of a pegboard.

In the assembly of the attachment piece and the bin, the rod portions 30 are forced downwardly into the gaps 28 of the U-shaped arms 26 so as to thereby rigidly hold the bin on the attachment piece by a friction fit. As shown in FIG. 2, by the rod portions being slidably mounted within the gaps 28 of the arms 26, the bins are slidable side to side by at least a distance of three quarters of an inch.

This allows for the positioning of the bins on a pegboard with some leeway as to extend beyond the side edges 14 of the pegboard. By this mechanism, various widths of pegboard can be accommodated without the loss of positioning of every bin in a row of bins.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

We claim:

1. A display assembly comprising a storage bin to be mounted on a pegboard, and an attachment piece for mounting of the storage bin on the pegboard, the attachment piece including a plate having arms on one side of the plate and hooks on an opposite side of the plate, the arms inter-engaging with the bin and the hooks inter-engaging with the pegboard, a rear wall of the bin including a U-shaped projection for engagement with the arms on the one side of the plate of the attachment piece, the U-shaped projection being secured to the bin at two spaced locations, the two spaced locations being located at opposite sidewalls of the bin, the bin being slidably mounted on the attachment piece by the U-shaped projection for sideways movement of the bin between the two spaced locations of the U-shaped projection so as to provide complete side to side movement of the bin with respect to the attachment piece, only limited by the two spaced locations of the sidewalls of the bin where the U-shaped projection is secured to the bin.

2. The display assembly of claim 1, wherein the plate is T-shaped.

3. The display assembly of claim 1, wherein there are two arms and the two arms are U-shaped.

4. The display assembly of claim 3, wherein the U-shaped projection includes at least one rod portion for engagement with the arms of the attachment piece.

5. The display assembly of claim 4, wherein a thickness of the plate is reduced from a lower edge of the plate to an upper edge of the plate.

6. The display assembly of claim 4, wherein the at least one rod portion is secured in said arms by a snap friction fit.

* * * * *